US005517701A

United States Patent [19]

Johnson

[11] Patent Number: 5,517,701

[45] Date of Patent: May 21, 1996

[54] TOILET FLUSH CONTROL ASSEMBLY AND METHODS

[76] Inventor: Dwight N. Johnson, 6327 Chorlito Dr., Carlsbad, Calif. 95008

[21] Appl. No.: 333,070

[22] Filed: Nov. 1, 1994

Related U.S. Application Data

[63] Continuation of Ser. No. 224,648, Apr. 7, 1994, Pat. No. 5,392,470.

[51] Int. Cl.[6] ..... E03D 1/35

[52] U.S. Cl. ..... 4/394; 4/378

[58] Field of Search ..... 4/324, 325, 366, 4/367, 378, 379, 385, 391, 394, 395, 402, 415, 353; 137/391, 441

[56] References Cited

U.S. PATENT DOCUMENTS

| | | | |
|---|---|---|---|
| 3,705,428 | 12/1972 | Braswell | 4/402 X |
| 3,816,856 | 6/1974 | Braswell | 4/391 |
| 4,651,359 | 3/1987 | Battle | 4/324 |
| 5,216,761 | 6/1993 | Isberg | 4/324 |

FOREIGN PATENT DOCUMENTS

| | | | |
|---|---|---|---|
| 0221881 | 6/1942 | Switzerland | 4/391 |

*Primary Examiner*—Robert M. Fetsuga
*Attorney, Agent, or Firm*—Mason, Kolehmainen, Rathburn & Wyss

[57] ABSTRACT

A gravity flush toilet system includes a fixture with a water sealed trap and a tank having an overflow tube, a flush valve and a fill valve. A control assembly includes a float assembly with a member for pushing the flush valve toward its closed position as the water level descends. A full volume or a reduced volume flushing operation is selected by alternatively filling or emptying a bias chamber of the float assembly. Water pressure variations are compensated for by increasing the weight of the float with part of the flow through the fill valve as the tank is emptying. A regulated volume of reseal water is carried in a chamber on the float and is discharged into the overflow tube to refill the fixture trap after each flushing operation.

3 Claims, 4 Drawing Sheets

TOILET FLUSH CONTROL ASSEMBLY AND METHODS

This is a continuing application of application Ser. No. 08/224,648, filed Apr. 7, 1994 U.S. Pat. No. 5,392,470.

FIELD OF THE INVENTION

The present invention relates to an improved assembly and methods for controlling gravity flush toilets.

DESCRIPTION OF THE PRIOR ART

A conventional gravity type flush toilet system includes a toilet fixture that is flushed through a fixture trap and a tank in which a supply of water for a flush cycle is stored. In the normal at rest condition, the tank and the fixture each contain a predetermined quantity of water. The fixture is filled to a level that assures that the fixture trap is sealed by water, and the tank is filled to a level sufficient to assure that enough water is available for a flushing operation.

With the conventional system, a lever, knob or the like is operated by the user to initiate a flush operation by opening a flush valve near the bottom of the tank. Water flows rapidly from the tank through the flush valve to the fixture and empties the fixture as water siphons through the fixture trap to a drain. When the water level in the tank falls to a level near the level of the flush valve, the flush valve recloses and the siphon action in the fixture ends as the fixture is emptied through the fixture trap.

As the water level in the tank begins to drop at the start of the flush cycle, a fill valve opens to permit water to flow from a water supply into the tank. This flow of water continues while the water level in the tank falls during the flush operation, and continues after the flush valve recloses until the tank is refilled to the predetermined level. A fixed portion, typically twenty percent, of the flow through the fill valve is diverted to an overflow tube in the tank so that the fixture is refilled after the flush operation, thereby to reseal the fixture trap.

For a variety of reasons, water is wasted with this conventional toilet system. The amount of water consumed during a flush cycle is dependent on the water supply pressure. The fill valve is open as the tank water level decreases and the addition of water to the tank delays the reclosing of the flush valve. The fixture may be supplied with more water than required for effective flushing if the water supply pressure is relatively high.

In many conventional systems, only a single volume of flush water is possible. Every flushing operation consumes sufficient water for flushing of solid waste from the fixture, even though a reduced flow flush would suffice for flushing liquid waste. Although systems have been devised for varying the volume of flush water, unsolved problems remain.

Water can be wasted in resealing the fixture trap. Excess water supplied for resealing the trap is wasted as it flows over the trap to the drain. If the volume of flush water can be varied, it would be desirable to supply a consistent volume of reseal water for all flush cycles.

Avoiding the consumption of excess water has become an increasingly important goal. There is a long felt and ever increasing need for gravity flushing systems that minimize water use while retaining the ability to reliably and completely remove solid and liquid waste from the fixture. Although attempts have been made to provide toilet flushing controls and methods capable of decreasing water use by, for example, permitting a reduction of flush water volume for liquid waste disposal, known arrangements have not been able to consistently and reliably minimize toilet water use.

SUMMARY OF THE INVENTION

A primary object of the present invention is to provide apparatus and methods for reducing water use while controlling the operation of a gravity flush toilet system. Other objects of this invention are to provide apparatus and methods for achieving a constant volume of flush water, independent of variations in water supply pressure; to provide apparatus and methods for assuring that a constant volume of water is supplied to seal the fixture trap after each flushing operation; to provide apparatus and methods for controlling either a full or a reduced volume flush operation under the control of the user; to provide apparatus and methods in which excess water use is avoided by regulating water flow volume independently of water pressure; and to provide apparatus and methods for controlling a gravity flush toilet system that overcome disadvantages of known apparatus and methods.

In brief, in accordance with the invention there is provided a dual flush assembly for providing relatively small and large flush volumes in a gravity flush toilet system. The system has a toilet fixture with a water seal fixture trap. A tank is supplied with an overflow tube and with a flush valve for releasing tank water into the fixture and with a fill valve for replenishing tank water and for providing trap reseal water flow. The dual flush assembly includes a buoyant float assembly mounted for vertical movement in the tank and adapted to float upon the tank water. A flush valve closure member is mounted on the float assembly for pushing the flush valve toward its closed position when the float assembly descends to a predetermined level. A reseal water chamber receives the trap reseal flow from the fill valve. The reseal chamber is emptied into the overflow tube for resealing the fixture trap after a flushing operation. The float assembly includes a bias chamber that is emptied to increase the buoyancy of the float assembly for producing a relatively large flush volume and is filled to decrease the buoyancy of the float assembly for producing a relatively small flush volume.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
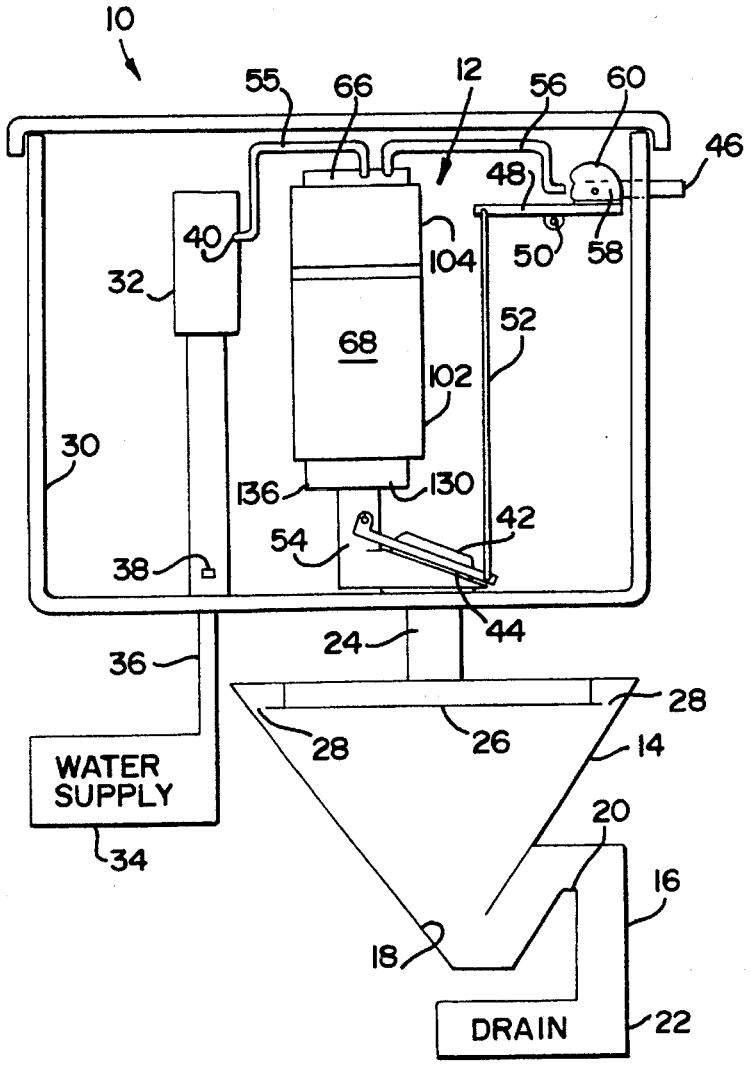
FIG. 1 is a schematic diagram of a gravity flush toilet system including a flush control assembly embodying the present invention.

Having reference now to the drawings, FIG. 1 illustrates in simplified and schematic fashion a gravity flush toilet system generally designated as 10 provided with a control assembly generally designated as 12 constructed in accordance with the present invention. The gravity flush toilet system 10 includes a fixture 14 having a water sealed trap 16 extending from the lower portion 18 of the fixture 14 over an elevated trap barrier 20 to a drain 22. Water for flushing the fixture 14 and for filling and resealing the trap 16 is supplied from a conduit 24 to a distribution manifold 26 having outlets 28 near the upper rim of the fixture.

A tank 30 holds a supply of water for flushing the fixture 14. A fill valve 32 admits water to the tank 30 from a water supply 34 and supply conduit 36. The fill valve has a main outlet 38 for admitting water to refill the tank 30 and a reseal outlet 40 for supplying water for resealing the trap 16 after a flushing operation. The fill valve has a float operated valve or other mechanism (not shown) for sensing changes in tank water level and permitting flow through the outlets 38 and 40 when the tank water level drops below a predetermined full level. A complete description of a fill valve that may be employed in the system 10 is set forth in U.S. Pat. No. 5,255,703 incorporated here by reference. Any other conventional fill valve may be used.

Flow of water from the tank 30 to the fixture 14 is controlled by a flush valve 42 that normally seats against a tank outlet port 44. The user rotates a control lever 46 to initiate a flush cycle. Rotation of the control lever 46 results in pivoting of an actuating lever 48 around its pivot axis 50 and this causes a strap or chain 52 to lift the flush valve 42 away from the port 44. As the flush cycle continues, the flush valve 42 remains open due to its buoyancy in the tank water. A complete description of a flapper type flush valve that may be employed in the system 10 is set forth in U.S. Pat. No. 4,499,616 incorporated here by reference. Any other conventional flush valve may be used if desired. An overflow tube 54 continuously communicates with the tank outlet port 44 and conduit 24. Reseal water from the outlet 40 flows through a reseal conduit 55 to the control assembly 12 mounted on the reseal tube 54.

System 10 is controlled by the assembly 12 to achieve flushing operations in which the waste of water is minimized. One way in which this is accomplished is by enabling a dual flush operation in accordance with which a flushing cycle may consume a relatively larger or relatively smaller volume of water. A control signal is provided to the control assembly 12 by a flush control conduit 56. As described below, when the tube 56 is blocked, the control 12 carries out a full volume flush operation suitable for the removal of solid waste from the fixture 14. Alternatively, when the tube 54 is unobstructed, the control 12 carries out a reduced volume flush cycle suitable for the removal of liquid waste from the fixture 14.

Any desired mechanism such as a separate, dedicated vent valve may be provided to enable the user to select a full volume or reduced volume flush cycle. In the illustrated system 10, the user selects a large volume flush by moving the control lever 46 up and selects a small volume flush by moving the control lever 46 down. Either direction of rotation causes a cam 58 to rotate and pivot the actuating lever 48 in order to open the flush valve 42. However, when the lever 48 is lifted, a raised portion 60 of the cam 58 blocks the normally unobstructed end of the flush control conduit 56 and the control 12 carries out a full volume flush operation.

Figure 3:
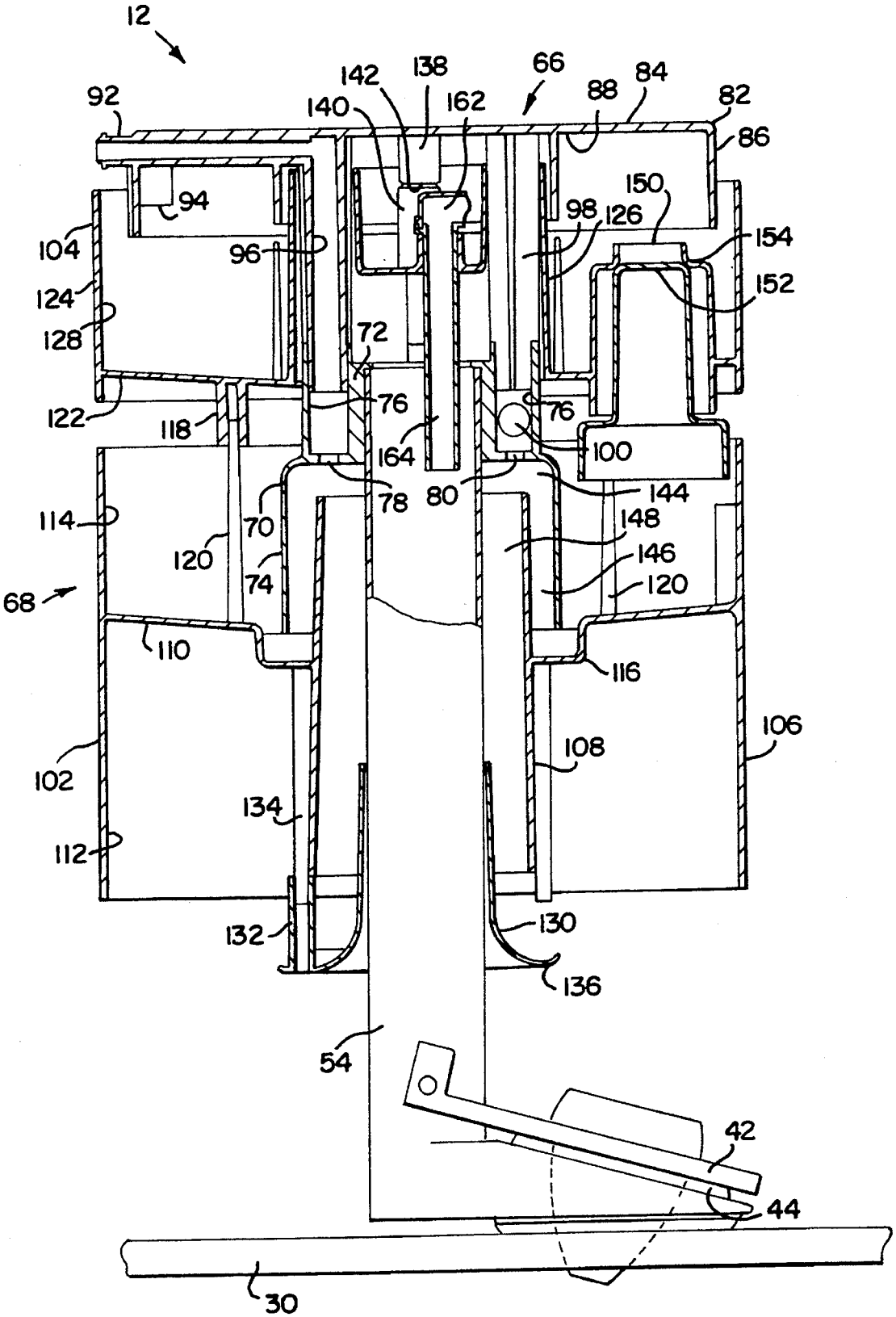
FIG. 3 is a vertical sectional view of the assembly taken along a line generally indicated by 3—3 in FIG. 2 showing the elements of the assembly in their normal at rest condition.
Figure 4:
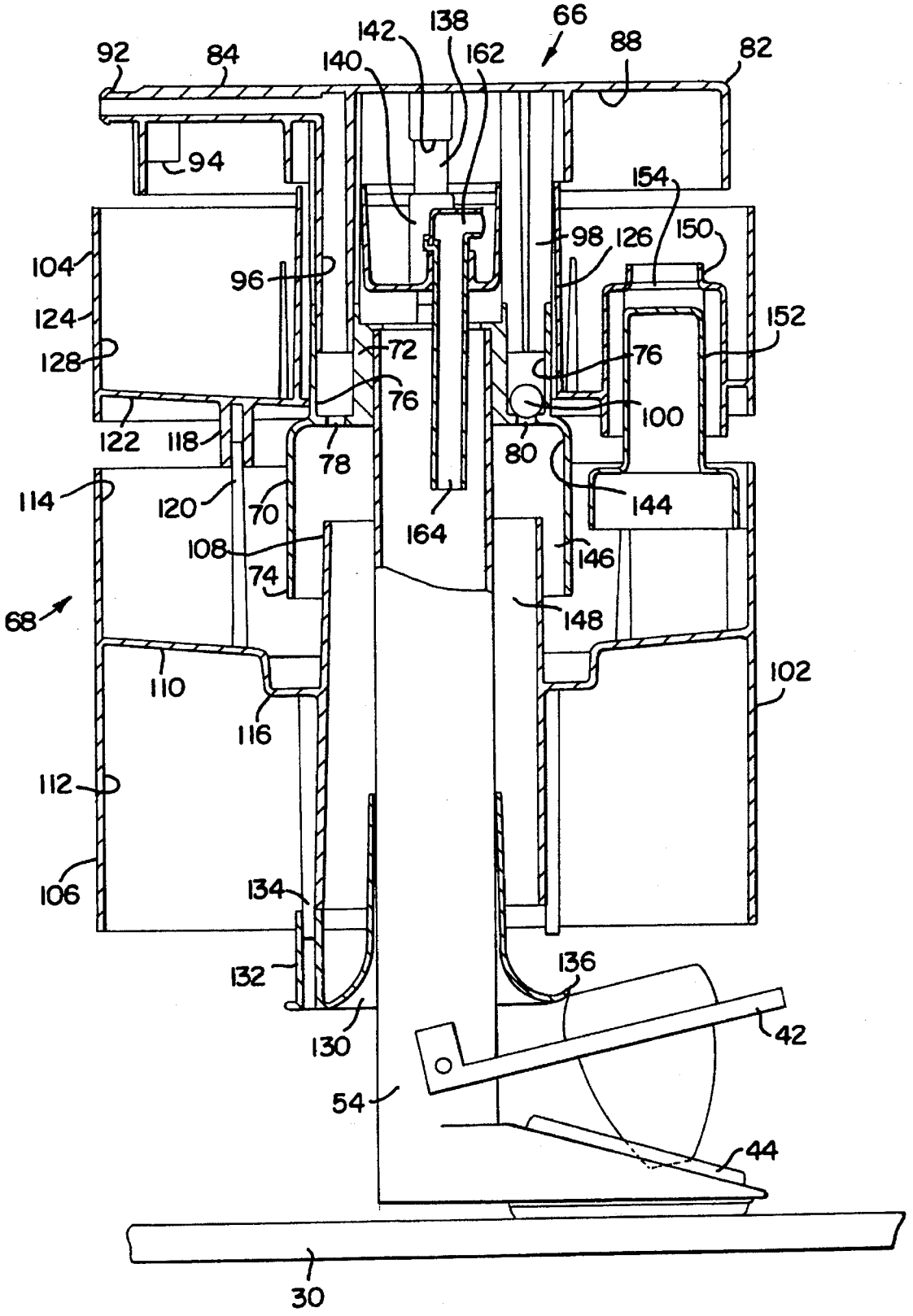
FIG. 4 is a view similar to FIG. 3 showing the components of the assembly near the end of a flush cycle.

In general the control 12 includes a support assembly 66 mounted on the overflow tube 54 and a float assembly 68 mounted for vertical movement on the float assembly 66 (FIGS. 3 and 4). The support assembly 66 includes a bell member 70 having a cylindrical collar 72 supported on the end of the overflow tube and a cylindrical depending skirt portion 74. A pair of sockets 76 extend up from the top of the skirt 74 at opposite sides of the collar 72. Openings 78 and 80 extend between the sockets 76 and the interior of the skirt 74.

Figure 2:
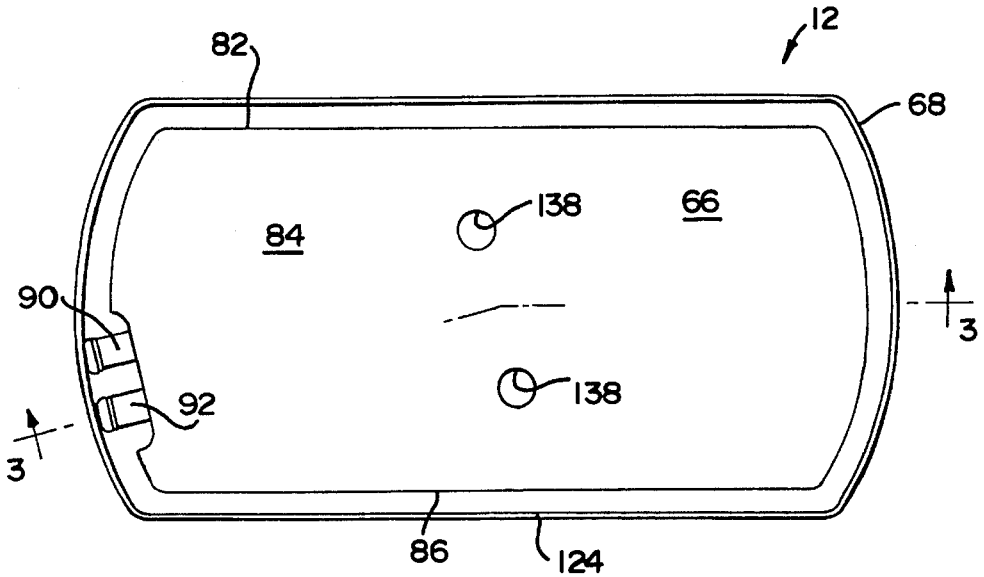
FIG. 2 is a top view of the flush control assembly of the present invention.

The support assembly 66 also includes a cover 82 having a top wall 84 and a depending peripheral flange 86 surrounding an air chamber 88. A reseal inlet 90 (FIG. 2) and a control inlet 92 project from the flange 86 and are connected to the reseal conduit 55 and the flush control conduit 56 respectively. The reseal inlet 90 communicates with a reseal port 94 opening downward under the top wall 84. The flush control inlet 92 communicates with a downwardly extending tube 96 that is received in one of the sockets 76. Thus the flush control conduit 56 is in continuous communication with the underside of skirt 74 through the opening 78.

A support post 98 with an X-shaped cross section extends from the top wall 84 and into the other socket 76. A buoyant ball check 100 is captured within socket 76 and alternatively seals the opening 80 (FIG. 4) or floats to permit flow through the opening 80 and out of the socket 76 along the post 98 (FIG. 3). The bell member 70 and cover 82 are attached to one another by engagement of the tube 96 and post 98 in sockets 76.

The float assembly 68 includes a float body 102 and a tray 104. The body 102 includes an upstanding peripheral wall 106 and a cylindrical inner collar 108. An inclined wall 110 extends between the wall 106 and collar 108 to separate a downwardly opening floatation chamber 112 from an upwardly facing bias chamber 114. Wall 110 defines a central basin portion 116 within the bias chamber 114 surrounding the collar 108.

The tray 104 is mounted above the float body 102 by sockets 118 that receive mounting pins 120 projecting upward from the wall 110 of the body 102. A base wall 122 extends between outer and inner peripheral walls 124 and 126 to define an upwardly facing reseal chamber 128.

A flush valve closing member 130 is attached below the float body 102 by sockets 132 on member 130 that receive mounting pins 134 extending beyond the lower end of the collar 108. The member 130 includes an outer rim 136 that overlies and is aligned with the flush valve 42.

The float assembly 68 surrounds the overflow tube 54 and is retained and guided on the support assembly 66 for vertical movement in response to tank water level changes. A plurality of guide posts 138 extend down from the top wall 84 of the cover 82. Each guide post 138 is slidably received in a guide sleeve 140 of the tray 104. The posts 138 include shoulders 142 (FIG. 4).

In the normal at rest condition of the system 10, the water level in the fixture 14 is at or slightly below the elevation of the fixture trap barrier 20. The water in the trap 16 isolates the fixture 14 from the drain 22. The tank water level is maintained by the fill valve 32 at an elevation slightly above the upper edge of the outer peripheral wall 106 of the float body 102. Air trapped in the floatation chamber 112 causes the float assembly to be buoyant in the tank water, and the float assembly is in its upper position seen in FIG. 3 with guide sleeves 140 adjacent the shoulders 142. The bias chamber 114 is flooded with water flowing over the top edge of the wall 106.

In accordance with a feature of the invention, the weight of the float assembly 68 is varied in order to change the volume of water supplied for a flushing operation. In order to initiate a reduced volume flushing operation, the user lowers the lever 46. The flush control conduit 56 remains unobstructed and vents the region inside the skirt 74 through the opening 78. The flush valve 42 opens and water is released into the fixture 14. The tank water level falls due to the release of water through the tank outlet port 44. Initially the float assembly 68 remains in its upper position seen in FIG. 3. Part of the water in the bias chamber 114 flows over the top edge of the inner collar 108 and down into the tank. The rest of the water remains in the bias chamber and is added to the weight of the float assembly 68.

When the tank water level falls a sufficient amount, the float assembly 68 descends with the falling tank water level. When the float assembly reaches the position seen in FIG. 4, the rim 136 of the valve closing member 130 engages the flush valve 42. The flush valve 42 is pushed toward its closed position until the discharge flow closes the flush valve 42 to terminate the flushing operation.

In order to initiate a full volume flushing operation the user lifts the lever 46. The flushing operation proceeds as described above, except that the flush control conduit 56 is obstructed by the raised portion 60 of the cam 58. As a result, the weight of the float assembly is decreased by discharging the water from the bias chamber. The float assembly floats higher in the tank water, and more water flows from the tank 30 before the float assembly descends to the position of FIG. 4 and closes the flush valve 42.

When the control conduit 56 is obstructed, it does not vent the region within the skirt 74 of the bell member 70 through the opening 78. As the tank water level falls with the float assembly remaining in its upper position of FIG. 3, the water in the bias chamber 114 flows to the tank along a siphon path 144 including an annular upward leg 146 defined between the skirt 74 and the inner collar 108 and a annular downward leg 148 defined between the collar 108 and the overflow tube 54. The opening 80 is closed by the ball check 100 during the siphon operation. The water in the chamber 114 falls to the level of the basin portion 116, decreasing the weight of the float assembly. After the bias chamber 114 is empty and as the tank water level continues to fall, the float assembly begins its downward movement toward the position of FIG. 4. The rim 136 contacts the flush valve 42 relatively later and a full volume flush operation results.

Water introduced into the tray 104 from the reseal port 94 compensates for differences in water supply pressure and also supplies a constant volume of reseal water to the fixture trap 16 in either a full or a reduced volume flush cycle. When the flush valve 42 is opened and the tank water level begins to fall, the fill valve opens and water flows from the water supply 34 through the main and reseal outlets 38 and 40. Flow through the main outlet 38, eighty percent of the total, enters the tank 30. The reseal water, twenty percent of the total, flows through the conduit 55, into the reseal inlet 92 and exits from port 94 into the reseal chamber 128 of the float assembly 68.

Throughout the flush cycle from the time the flush valve 42 and fill valve 32 open until the time the flush valve 42 is closed, water flows into the tank 30 from the main fill valve outlet 38 and water flows into the reseal chamber 128 through the reseal outlet 40. The main water flow tends to prolong the flush cycle by slowing the rate at which the tank water level falls. Conversely, the flow into the reseal chamber 128 tends to shorten the flush cycle by increasing the weight of the float assembly 68 so that it reaches the flush valve closing position of FIG. 4 relatively sooner. The ratio of the area of the tank 30 to the area of the reseal chamber 128 should be the same as the ratio of main flow and reseal flow through the fill valve 32. Preferably the reseal flow is twenty percent of the total fill valve flow and the reseal chamber area is twenty percent of the total tank area. Variations in water supply pressures vary both the main and reseal flows proportionally, and as a result the flush volume does not vary with differences in water supply pressure.

When the flush valve 42 recloses at the end of a flush cycle, the tank water level begins to rise as a result of water supplied to the tank 30 through the main fill valve outlet 38. The float assembly 68 rises to its upper position during the first segment of the tank refilling operation. The water level in the reseal chamber 128 continues to rise during and after the flush operation until the reseal water level reaches the elevation of a cylindrical overflow weir wall 150 that projects up from the base wall 122 of the tray 104. The water level in the reseal chamber is held at this elevation by overflow through the weir wall 150 as the tank water level continues to rise. This provides a regulating function and assures that a consistent amount of reseal water is present near the end of the tank refilling operation, independently of whether a full volume flush or a reduced volume flush operation occurs.

As the tank water level rises toward the full level at which the fill valve 32 closes, the bias chamber 114 is refilled by water flooding from the tank 30 over the upper edge of the peripheral wall 106 of the float body 102. The siphon 144 is purged of air by the release of air through the opening 80, around the floating ball check 100 and along the support post 98.

As the tank water level nears the full level, a reseal float 152 containing trapped air is lifted against a weir seat 154 defined by a shoulder within the weir wall 150. This closes the overflow path and permits the reseal chamber 128 to continue to fill with additional reseal water. When the reseal water level reaches the lower edge of the flange 86 of the cover 82, the area into which reseal water can flow is substantially reduced due to air trapped within the chamber 88 of the cover 82. As a result, the filling of the reseal chamber is quickly completed as the water level rises in the gap between the walls 124 and 86.

Figure 5:
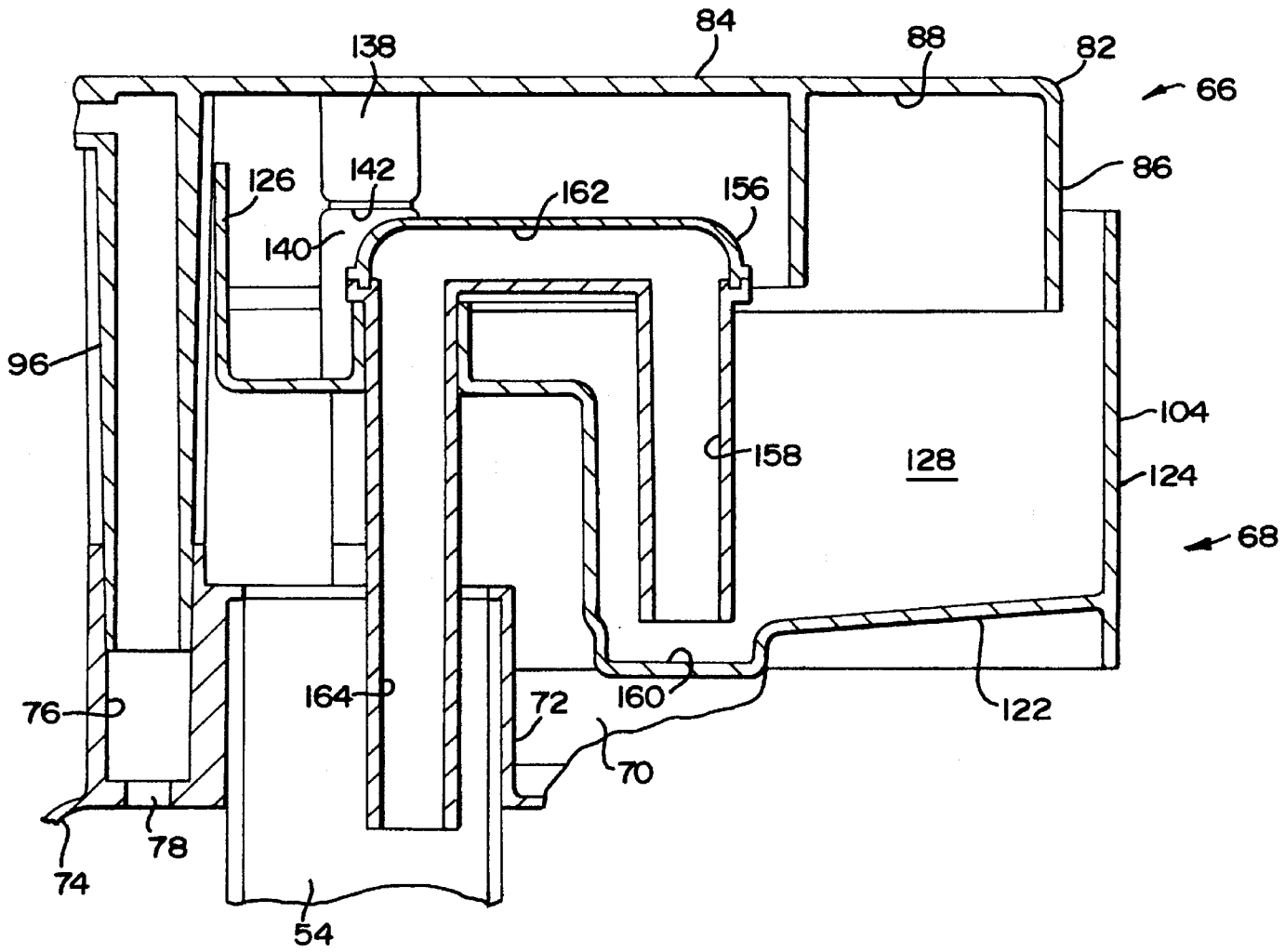
FIG. 5 is a fragmentary enlarged sectional view showing the reseal siphon of the assembly.

Slightly before the tank 30 is entirely full, the water level in the reseal chamber 128 reaches the elevation of a reseal siphon 156 best seen in FIG. 5. The siphon 156 includes an inlet leg 158 aligned with a sump 160 defined in the wall 122, a top leg 162 and an outlet leg 164 located inside the tank overflow tube 54. When the reseal water level reaches the elevation of the top leg 162, the reseal water stored in the reseal chamber is discharged by the siphon through the overflow tube 54 and into the fixture 14 where it refills and seal the fixture trap 16 the trap.

While the present invention has been described with reference to the details of the embodiments of the invention shown in the drawing, these details are not intended to limit the scope of the invention as claimed in the appended claims.

What is claimed is:

1. A control assembly for controlling the operation of a gravity flush toilet system having a fixture with a fixture trap, a water tank, a flush valve mounted in the tank for movement between a closed position to an open position for releasing water from the tank into the fixture, a manual actuator coupled to the flush valve for opening the flush valve and a fill valve for adding water to the tank when the tank water level is below a predetermined full water level, said assembly comprising:

a support adapted to be mounted in the tank;

a buoyant float assembly carried by said support for movement independently of the flush valve up and down in said tank in response to tank water level changes;

said float assembly including a water chamber;

said float assembly including a flush valve closing member aligned with the flush valve for contacting the flush valve and moving the flush valve to a closed position when the float assembly descends to a predetermined level; and means for adding water to said chamber at a rate proportional to flow through the fill valve for increasing the weight of said float assembly and compensating for variations in the rate of flow through the fill valve.

2. A control assembly as claimed in claim 1 wherein said means for adding water includes means defining a flow path for reseal water supplied by the fill valve.

3. A control assembly as claimed in claim 1 further comprising means for supplying water from said chamber to the trap fixture after the flush valve is closed.

* * * * *